US005996344A

United States Patent [19]

Frenette et al.

[11] Patent Number: 5,996,344

[45] Date of Patent: Dec. 7, 1999

[54] BUOYANCY DEVICE FOR PROVIDING ROTATIONAL TORQUE TO A SHAFT

[76] Inventors: Eugene Roland Frenette, 223 Rabbit Rd., Salisbury, N.H. 03268; Henry Eugene Frenette, 101 Berry Pond Rd., Pittsfield, N.H. 03263

[21] Appl. No.: 09/182,399

[22] Filed: Oct. 29, 1998

[51] Int. Cl.[6] ..... F03C 1/00

[52] U.S. Cl. ..... 60/496; 60/495

[58] Field of Search ..... 60/495, 496

[56] References Cited

U.S. PATENT DOCUMENTS

| | | | |
|---|---|---|---|
| 2,513,692 | 7/1950 | Tubbs | 60/496 X |
| 3,934,964 | 1/1976 | Diamond | 60/495 X |
| 4,683,720 | 8/1987 | De Shon | 60/496 |

*Primary Examiner*—Hoang Nguyen

*Attorney, Agent, or Firm*—Davis and Bujold

[57] ABSTRACT

A hollow shaft (10) supporting a plurality of buoyancy legs (18) equally spaced about the periphery of the hollow shaft (10). One end of each buoyancy leg (18) is connected to the shaft (10) in a water tight manner while the opposite end of each buoyancy leg (18) supports a buoyancy chamber (22). A piston (38) is located within the buoyancy chamber (22) and is movable from a fully retracted state to a fully extended state by operation of a weight (44). The buoyancy chamber (22), when in a fully retracted state, being substantially full of water and providing a balanced state for the shaft (10). The piston (10), when in a fully extended state, providing a buoyant state of the buoyancy chamber (22) which impart rotational torque on the shaft (10). A mechanism is provided for automatically changing the position of the piston (38), from the fully retracted state to the fully extended state, or, from the fully extended state to the fully retracted state each time the buoyancy leg (18) is located in a substantially vertical orientation.

20 Claims, 8 Drawing Sheets

BUOYANCY DEVICE FOR PROVIDING ROTATIONAL TORQUE TO A SHAFT

BACKGROUND OF THE INVENTION

The present invention relates to a buoyancy device which is used within a supply of water to provide rotational torque to a shaft for outputting the rotational energy for a desired end use.

SUMMARY OF THE INVENTION

Wherefore, it is an object of the present invention to provide a plurality of buoyancy legs on a rotational shaft with each buoyancy leg having a buoyancy cavity, cylinder or chamber that can be inflated and deflated with air, as desired, to provide a desired buoyancy to the remote free end of the buoyancy leg and facilitate rotation of the shaft about a rotational axis.

A further object of the invention is to coordinate the air inflation and deflation of the buoyancy cavity, cylinder or chamber, supported by the remote end of each buoyancy leg, to provide the desired rotation of the shaft about the rotational axis.

Another object of the invention is to a shaft supporting a buoyancy leg carrying a buoyancy chamber which, when inflated, providing rotation to the shaft, said shaft comprising: an elongate substantially at least partially hollow shaft and defining a rotation axis; at least one buoyancy leg being supported by the shaft, said at least one buoyancy leg being coupled to the shaft, in a fluid tight manner, and the at least one buoyancy leg extending substantially perpendicular and radially from rotational axis of the said shaft; a remote end of said buoyancy leg supporting a buoyancy chamber containing a piston, and the piston, when in a first state, providing a substantially balanced state for the shaft, and the piston, when in a second state, causing the buoyancy chamber to become buoyant and thereby supply rotational energy to the shaft, once the buoyancy chamber is immersed in water.

DESCRIPTION OF THE DRAWINGS

The invention will now be described, by way of example, with reference to the accompanying drawings in which.

DESCRIPTION OF THE PREFERRED EMBODIMENTS

Figure 1:
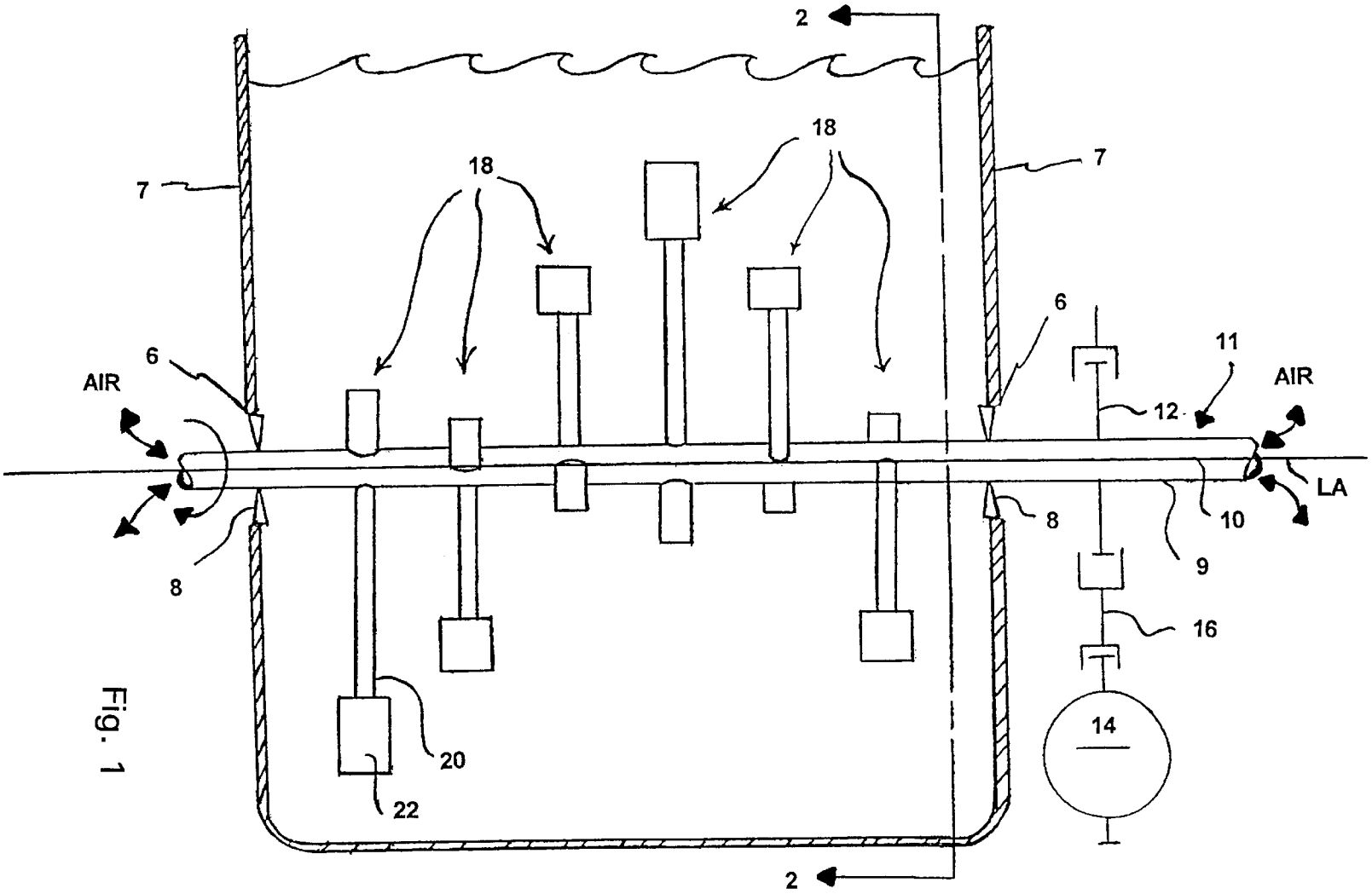
FIG. 1 is a diagrammatic front elevation of the rotational buoyancy device according to the present invention.
Figure 2:
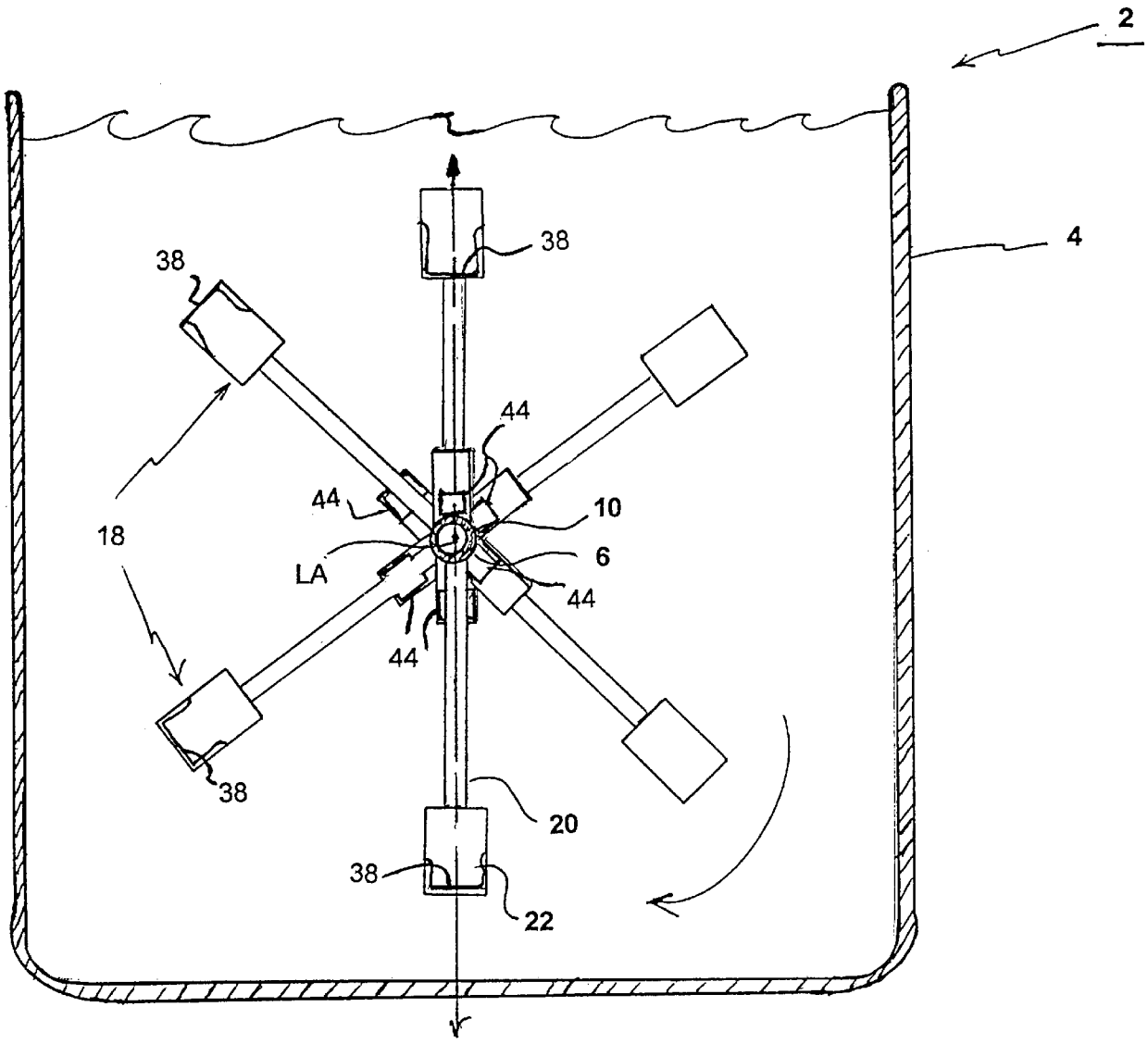
FIG. 2 is a diagrammatic end view of the buoyancy device along section line 2—2 of FIG. 1.

Turning now to FIGS. 1 and 2, a detailed description concerning the basic components of the present invention will now be provided. The buoyancy device 2 comprises an enlarged tank 4, or some other source of water, which is sized to hold a desired quantity of water, e.g. between about 200 to about 6000 gallons of water, for example, depending upon the torque to be generated by the buoyancy device 2. The tank 4 can have a dimension of about 3 to about 12 feet wide, and about 4 to about 15 feet long and about 3 to about 12 feet high, for example. A pair of circular apertures 6 are centrally formed in two opposed sidewalls 7 of the tank 4 and each aperture 6 supports a waterproof bearing 8 in a conventional water tight manner to prevent any leakage of water past the bearings. An exterior surface 9 of the cylindrical shaft 10 is accommodated by an inner race of each of the waterproof bearings 8 and an end of the shaft 10 extends out past both the opposed sidewalls 7 of the tank 4 and is preferably open. At least one projecting end portion 1 1 of the shaft 10 supports a gear 12, or some output or drive mechanism, for transmitting the torque generated by the shaft 10 of the buoyancy device 2 to a desired machine, gear, object 14, via a chain, a belt drive or other transmission mechanism 16. The desired machine, gear, object 14 can be, for example, an electric generator, a transmission, a motor, a mechanical drive, a fan, etc.

As seen in FIGS. 1 and 2, a plurality of equally spaced buoyancy legs 18 are supported by the exterior surface 9 of the shaft 10 in a conventional water tight manner. The buoyancy legs 18 are equally spaced from one another about the periphery of the shaft 10 and are also spaced axially along the shaft 10, a desired distance, to provide sufficient clearance for operation of the internal components of the buoyancy legs 18, within the shaft 10, and a further detail description concerning the function of the same will follow below.

The free remote end 20 of each buoyancy leg 18 is provided with a buoyancy cylinder, cavity or chamber 22 which, when in a deflated state (FIG. 3) provides a substantially balanced state for the shaft 10 and, when the buoyancy chamber 22 is in an inflated state (FIG. 4), the buoyancy of the buoyancy chamber 22 generates or imparts rotational torque on the shaft 10 which rotates the shaft 10 in a clockwise direction, for example, as can be seen in FIG. 2 about a rotational axis LA.

Preferably the shaft 10 supports at least two buoyancy legs 18 and more preferably the shaft 10 supports between three to six buoyancy legs 18. It is to be appreciated, however, that the number, the size, the dimensions and/or the spacing of the buoyancy legs 18 on the shaft 10 can vary from application to application. In addition, there could be more then one set or group of buoyancy legs 18 provided along the length of the shaft 10 and the utilization of more then one set or group of buoyancy legs 18 will, in turn, increase the amount of torque generated on the shaft 10 by the buoyancy legs 18 once the buoyancy chambers 22 becomes inflated. Further, it is to be appreciated that the length of the buoyancy legs 18 as well as the size, the shape, the capacity and the dimensions of the buoyancy chamber 22 will also dictate the amount of torque being generated on the shaft 10 by the buoyancy legs 18. As such teaching is well known to those skilled in the art, a further detailed description is not provided.

In the shown embodiment of FIGS. 1 and 2, six buoyancy legs 18 are supported by the shaft 10 and each one of the buoyancy legs 18 is separated, along the circumference of the shaft 10, from an adjacent buoyancy leg 18 by an angle of approximately 600. Each buoyancy leg 18 is spaced axially, along the axial length of the shaft 10, from one another by a distance of about 3 to about 24 inches or so, for example. As all six buoyancy legs 18 are substantially identical to one another in their assembly and function, a detailed description concerning only one buoyancy legs 18 will now be provided.

Figure 3:
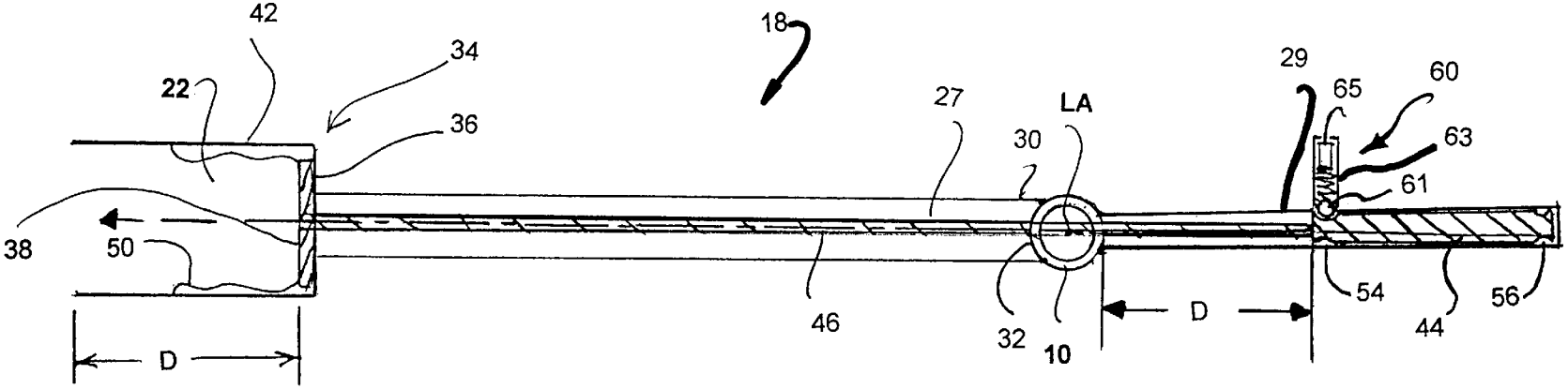
FIG. 3 is a diagrammatic cross-sectional view showing the arrangement of the internal components of a buoyancy leg when the buoyancy chamber is in a deflated state.
Figure 4:
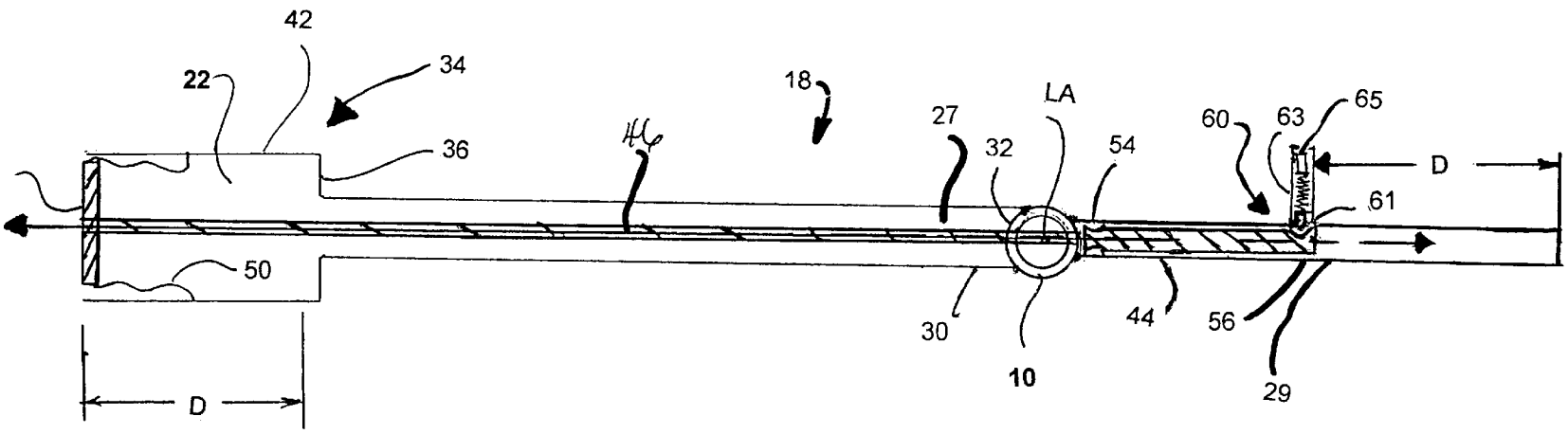
FIG. 4 is a diagrammatic cross-sectional view showing the arrangement of the internal components of the buoyancy leg when the buoyancy chamber is in an inflated state.

As shown in FIGS. 3 and 4, each one of the buoyancy legs 18 comprises a first section 27, of an elongate hollow shaft 28, having a length of between a few inches to a few feet or so, preferably between 6 inches to about 6 feet or so. A first proximate end 30 of the buoyancy leg 18 is sized to mate with a similarly sized aperture 32 provided in the shaft 10 and is either welded, threaded or otherwise permanently affixed or secured to the shaft 10 at the desired angle and in a water tight manner. It is to be appreciated that each buoyancy leg 18 is aligned and extends perpendicular with respect to the longitudinal axis/rotation axis LA of the shaft 10 and also extends precisely radial thereto to provide the proper operation of the buoyancy leg 18 during use.

A second section 29 of the buoyancy leg 18 is provided on the opposite side of the shaft 10 and secured thereto in a water tight manner, and a further detailed description concerning the importance and function of the second section 29 will follow below. The second section 29 has a length of between a few inches to a few feet, preferably between about 1 foot and a few feet.

A second free remote end 34 of each buoyancy leg 18 supports the buoyancy chamber 22 which is cavity or chamber that is open, at an extreme remote end thereof, to the external environment, e.g. the supply of water. A The buoyance chamber 22 has a length of between 6 inches to about 18 inches or so and defines a cavity size of about 20 to about 200 cubic inches, more preferably about 72 cubic inches. An opposite end 36 of the buoyancy chamber 22 tapers to a smaller diameter, e.g. a diameter of between about 3 inches to about and ½ inch or so, and is connected to the free end of the first section 27 of the buoyancy leg 18, which is generally a hollow member. A planar piston 38, having a small clearance fit with the inner surface 40 of the exterior housing 42 defining the buoyancy chamber 22, is supported within the buoyancy chamber 22 and allowed to move to and fro within the buoyancy chamber 22. The piston 38 is coupled to a weight 44, e.g. a weight weighing about 25 pounds, located on the opposite side of the shaft 10, via an elongate linkage arm 46. The linkage arm 46 can have an adjustable length, if desired, and the linkage arm 46 controls operation of the piston 38 and a further detailed description concerning these components and their function will follow below. As adjustment of the linkage arm 46 is conventional and well known in the art, a further detailed description concerning the same is not provided.

An outer periphery of a diaphragm 50 is sealingly connected with an inner intermediate surface of the housing 42, defining the buoyancy chamber 22, and a central portion of the diaphragm 50 is glued or otherwise permanently affixed or secured to an outwardly facing surface of the piston 38, opposite the linkage arm 46 such that the diaphragm 50 will also be moved in response to movement of the piston 38. The diaphragm 50 provides a movable water tight/airtight barrier or seal between the air and water interface and the position of the barrier is altered by operation of the piston 38. A further detailed description concerning the operation and the function of the same will follow.

The second shorter section 29 of the buoyancy leg 18 is located on the opposite side of the shaft 10 and is connected thereto, in a waterproof fashion, similar to the connection of the first section 27 of the buoyancy leg 18. The second section 29 of the buoyancy leg 18 is also substantially hollow and sized to accommodate a second end portion of the linkage arm 46 as well as the weight 44. The second section 29 of the buoyancy leg 18 provides a water tight and water free environment for those internal components. A plurality of bearings (not shown in detail) may be provided along the length of an inwardly facing surface of the buoyancy leg 18 to facilitate transverse motion of the linkage arm 46 along the hollow interior of the buoyancy leg 18.

The weight 44 is preferably a cylindrical weighted member which has a pair of opposed annular recesses or grooves 54, 56, one formed adjacent each opposed end face of the cylindrical weight 44. A spring biased detent 60 (FIGS. 3 and 4), such as a captively retained ball bearing 61 biased by a compression spring 63, is supported by a central region of the shorter second section 29 of the buoyancy leg 18 and the ball bearing 61 is biased into engagement with one of the annular grooves 54 or 56 of the weight 44. The tension of the compression spring 63, of the spring biased detent 60, is adjusted by a set screw 65 to provide a desired tension for controlling operation of the weight 44. As such set screw adjustment is well known in the art, a further detailed description concerning the same is not provided. The spring 63 facilitates proper engagement of the ball bearing 61 with one of the annular grooves 54, 56 for controlling operation of the buoyancy device 2, and a further detailed description concerning the same will follow.

Now that a basic disclosure concerning the fundamental components of the present invention was provided, a detail discussion relating to the setup and operation of the buoyancy device 2 is provided.

As can be seen in FIG. 3, the longer first and shorter second sections 27, 29 of the each buoyancy leg 18 are shown affixed to the shaft 10 in a balanced configuration. That is, assuming that the shaft 10 is supported by the pair of spaced apart bearings 8, the rotation force exerted by the shorter second section 29 of the buoyancy legs 18, including the weight 44, is equal to but opposite from the rotation force exerted by the longer first section 27 of the buoyancy leg 18, which supports the buoyancy chamber 22. As such, the shorter second and longer first sections 29, 27 of the buoyancy legs 18 are thus balanced so that no net rotation force is exerted on the shaft 10, in either rotational direction.

It is important to note that the overall buoyancy shape and size of the weight 44, as well as the spacing of the weight 44 relative to the rotational axis LA of the shaft 10, is selected so as to compensate and offset the total buoyancy and weight of the longer first section 27 of the buoyancy leg 18 when the piston 38 is in a fully retracted state or position, i.e. the piston 38 is in a position in which all of the air is expelled from the buoyancy chamber 22 and the diaphragm 50 is fully retracted inwardly of the chamber such that water, from the surrounding environment, is allowed to fill the buoyancy chamber 22 (FIG. 3).

Each one of the plurality of buoyancy legs 18 are similarly attached to the shaft 10 so that each buoyancy leg 18, when installed on the shaft 10 and the piston 38 is in its retracted position, is precisely balanced so that no net rotation force is exerted on the shaft 10 in either rotational direction. Once all the plurality of buoyancy legs 18 are similarly installed and balanced on the shaft 10, the tank 4 is filled with a quantity of water which is sufficient to fully immerse and completely cover the shaft 10 and all of the attached buoyancy legs 18. If desired, saltwater can be employed since buoyant objects are rendered more buoyant in saltwater than regular water and saltwater will thus optimize operation of the buoyancy device 2 according to the present invention.

Now that all of the relevant components of the buoyancy device 2 have been discussed, a detail discussion concerning the function and operation of the present invention will now be provided. In particular, a detailed discussion concerning a complete cycle or revolution of one of the buoyancy legs 18 will be provided, it being understood that each other buoyancy leg 18 operates identically but in a sequential fashion to provide the desired rotational torque to the shaft 10 during operation.

With reference to FIGS. 2, 3 and 4 a detailed description concerning the one revolution of the buoyancy leg 18, located substantially vertical and submerged the furthest within the water will now be provided, i.e. the buoyancy leg 18 located at the six o'clock position. When the buoyancy leg 18 is in this orientation, the weight 44 overcomes the biasing force provided by the spring biased detent 60 and moves radially inwardly toward the longitudinal axis LA of the shaft 10, e.g. the weight 44 drops vertically due to the force of gravity and the spring biased detent 60 releases its engagement with the first annular groove 54 and subsequently becomes engaged with the second annular groove 56 of the weight 44, once the weight 44 has moved sufficiently radially inwardly, to again lock and retain the weight 44 in that position. If necessary, a stop can be provided to prevent excess radially inward movement of the weight 44. The movement of the weight 44, in turn, is directly transmitted to the piston 38 via the linkage arm 46. Such movement of the weight 44 and linkage arm 46 causes the piston 38 to move radially outward, within the buoyancy chamber 22, and dispel the water contained within the buoyancy chamber 22. Such motion of the piston 38, in turn, also simultaneously sucks air in from one or both of the opposed open ends of the shaft 10. The sucked air initially flows along the longitudinal axis LA of the shaft 10 and then radially downward through the longer first section 27 and into the buoyancy chamber 22 where the air collects and is retained. It is to be appreciated that the diaphragm 50, at all times, maintains a waterproof barrier between the water and air during use of the buoyancy device 2.

The air contained within and retained by the buoyancy chamber 22 alters the density of the buoyancy chamber 22, in turn, and this density change imparts a clockwise rotational force to the shaft 10, as seen in FIG. 2. This rotational force on the shaft 10 continues until the buoyancy leg 18 reaches a substantially vertical orientation, i.e. the buoyancy leg 18 arrives at the twelve o'clock position as seen in FIG. 2. It is to be appreciated that the rotational force, exerted by the buoyancy leg 18 on the shaft 10, is a maximum at about the nine o'clock position and is at a minimum at both the six and the twelve o'clock positions. Once the buoyance leg 18 reaches the twelve o'clock position, the weight 44 again overcomes the biasing force of the spring biased detent 60 and is allowed to move radially outwardly away from the longitudinal axis LA, e.g. the weight 44 drops vertically due to the force of gravity, so that the spring biased detent 60 releases its engagement with the second annular groove 56 and subsequently becomes re-engaged with the first annular groove 54 of the weight 44, once the weight 44 has moved sufficiently radially outwardly. If necessary, a stop can also be provided to prevent excess radially outward movement of the weight 44. The movement of the weight 44 is also directly transmitted to the piston 38 via the linkage arm 46. Such movement of the weight 44 and linkage arm 46 causes the piston 38 to move radially inward and dispel the air contained within the buoyancy chamber 22, by forcing the diaphragm 50 radially inward. Such motion of the piston 38 expels the air from the buoyancy chamber 22. The expelled air flows radially inward, along the first section 27 of the buoyancy leg 18, toward the longitudinal axis LA of the shaft 10, and then axially toward one or both opposed open ends of the shaft 10.

Once all of the air is expelled, the weight 44 is again retained in a locked position, by the spring biasing detent 60, and the piston 38 is again located in its retracted state or position. The retraction motion of the piston 38 also simultaneously allows the buoyancy chamber 22 to become completely filled with water and alters this buoyancy leg 18 to its balanced state. It is to be appreciated that the balanced state does not significantly hinder, i.e. either impart or prohibit, rotation of the shaft 10 in either direction.

Accordingly, when another buoyancy leg 18, located at the six o'clock position, becomes buoyant, the buoyancy leg 18 oppositely located at the twelve o'clock position has just been adjusted to its balanced state and thus will not significantly hinder or inhibit the rotational torque generated by the inflated buoyancy chamber or chambers 22, as seen on the left side of the drawing of FIG. 2.

The buoyancy leg 18 which was just adjusted to the balanced state, i.e. the buoyancy leg 18 at the twelve o'clock position, will continue rotating in its adjusted balance state, due to the locking of the weight 44 by the spring biased detent 60, until the buoyancy leg 18 again reaches the six o'clock position which thus completes one cycle or revolution of that buoyancy leg 18. When the buoyancy leg 18 again reaches the six o'clock position, the weight 44 will fall, due to the force of gravity, and dispel the water from the buoyancy chamber 22 and simultaneously suck air into the buoyancy chamber 22 to render the buoyancy leg 18 buoyant again to provide rotational drive to the shaft 10, as discussed above. Each buoyancy leg, when located at the six o'clock position will operate as described above.

As will be appreciated from the above discussion, each buoyancy leg 18, when traveling from the six o'clock position to the twelve o'clock position, is buoyant and supplies rotational energy to the shaft 10 while each buoyancy leg 18, when traveling from the twelve o'clock position to the six o'clock position, is substantially balanced and thus neither supplies nor significantly hinders rotation of the shaft 10 about the rotational axis LA.

When the weight 44 moves radially inwardly, i.e. the buoyancy chamber is filled with air, the weight has less of a tendency to offset the clockwise motion of the shaft 10, as seen in FIG. 2, thereby further increasing the buoyancy effect of the buoyancy chamber 22.

It will be appreciated that the spring biased detent 60 can be replaced by a trigger mechanism which triggers operation of the weight 44, at precisely the six o'clock position, where the weight 44 is allowed to fall and inflate the buoyancy chamber 22, and again, at precisely the twelve o'clock position, where the weight 44 is allowed to fall and deflate the buoyancy chamber 44. As is apparent from the above discussion, the weight 44 must be able to travel a sufficient distance within the second section 29, e.g. distance D which is typically between about 6 and 18 inches or so, to ensure adequate movement of the piston 38 along the entire length of the buoyancy chamber.

Figure 5:
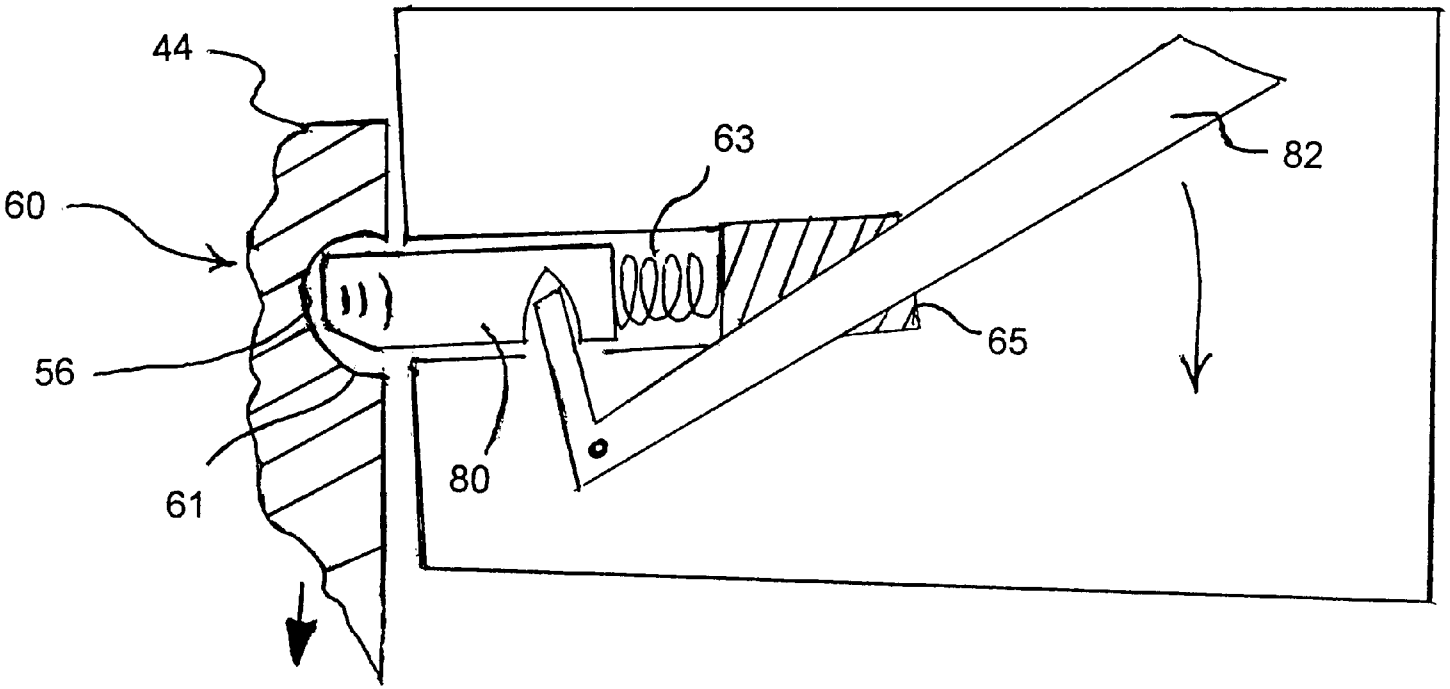
FIG. 5 is a diagrammatic view showing a second embodiment of the detent mechanism in a first position.

With reference to FIG. 5, a brief description concerning a second type of detent mechanism, for use with the present invention, will be provided. According to this embodiment, a pair of opposed detent mechanism 60' are provided on opposite ends and sides of the second section 29 of the buoyancy leg 18. As each detent mechanism 60' is identical in function, a detailed description concerning only one of the two detent mechanisms 60' will be provided.

Figure 6:
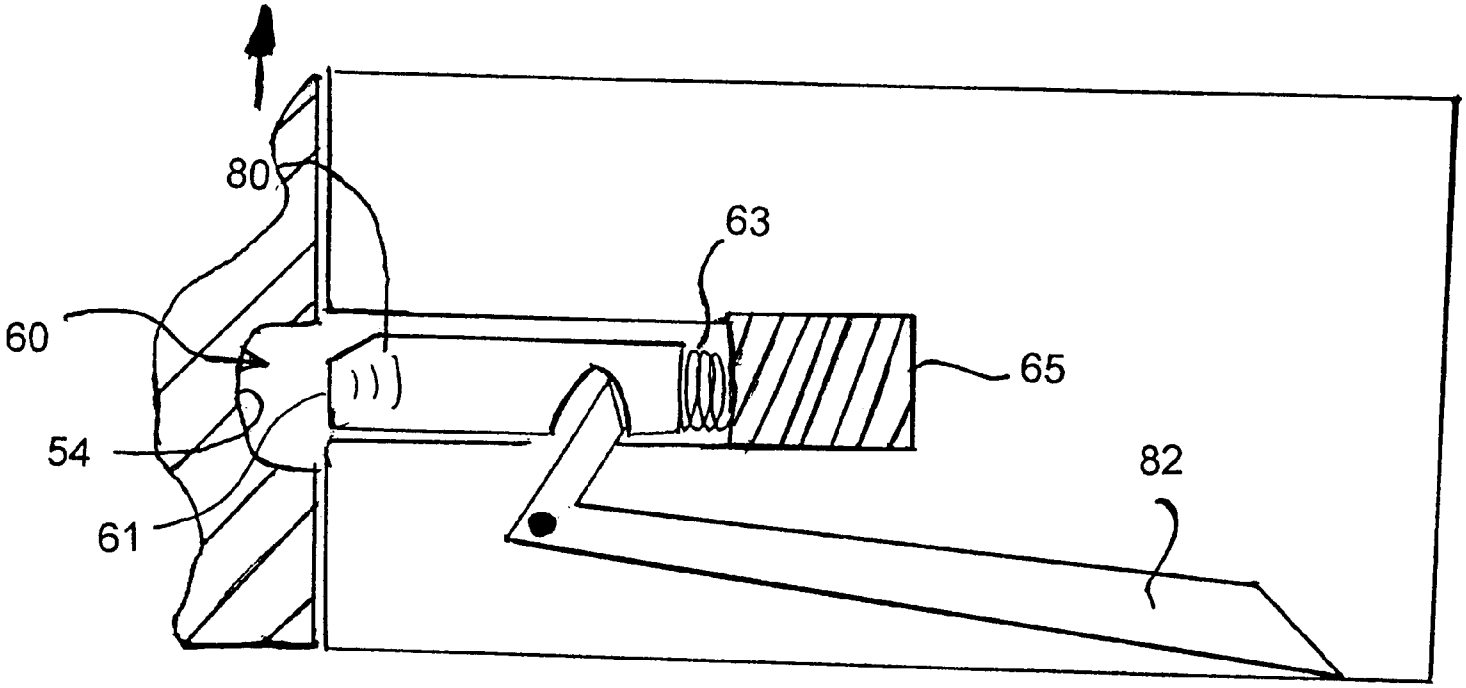
FIG. 6 is a diagrammatic view of the mating detent mechanism of FIG. 5 in a second position.

As seen in FIGS. 5 and 6, each detent mechanism 60' includes a latch 80 which is coupled to and controlled by a handle 82 in a conventional manner. The handle 82 is weighted, e.g. is supports a 1 to 3 pound weight, for example, and is movable between first (FIG. 6) and second (FIG. 5) extreme end positions. In the first end position of the handle 82 (FIG. 6), the latch 80 is continuously retained in a fully retracted state out of engagement with one of the annular recess 54, 56 of the weight 44, and in the second end position of the handle 82 (FIG. 5), the latch 80 is fully extended and brought into constant engagement with one of the annular recess 54, 56 of the weight 44 to lock the weight 44 and prevent undesired movement thereof. The detent mechanism 60', according to this embodiment, is supported on the second section 29 so that the detent mechanism 60' will only switch or change positions twice during each complete revolution of the buoyancy leg 18, i.e. once at precisely the six o'clock position and a second time at precisely the twelve o'clock position. It is to be appreciated that the two detent mechanisms 60' operate oppositely from one another. That is, when the lever 82 of one of the detent mechanisms 60' is fully extended, the lever 82 of the other detent mechanism 60' is fully retracted, and vice versa. One surface of the lever 82 can be rounded or beveled to facilitate engagement with the weight 44 in the event that the lever 82 is moved to its extended position prior to the weight ceasing to switch or change position.

The lever 82, supporting the weight, acts as a over center spring so that when the detent mechanism 60' has sufficiently rotated, the lever 82 and weight will change their position, due to the force of gravity, and will either retract or extend the latch 80, as desired, to either lock or release the weight 44. As shown in FIGS. 5 and 6, one complete cycle of the detent mechanism 60 will maintain the latch 80 in a fully retracted position, for approximately 180° of rotation, and will maintain the latch 80 in a fully extended locked position for approximately the remaining 180° of rotation.

Figure 7:
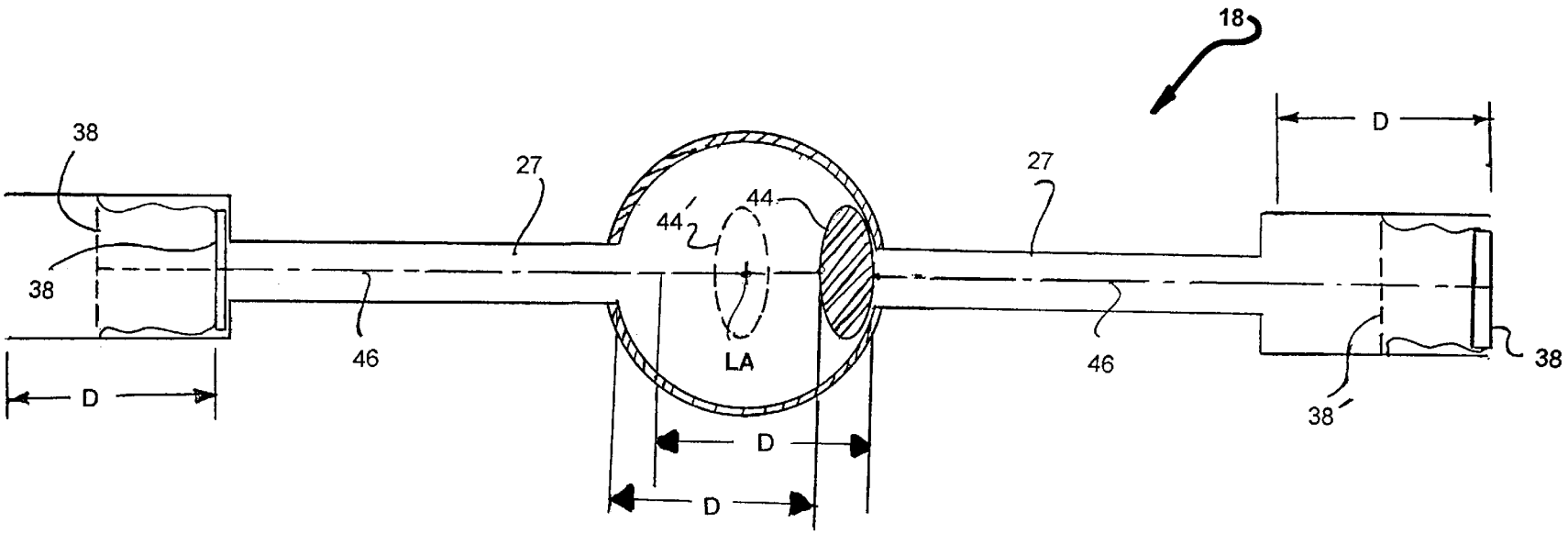
FIG. 7 is a diagrammatic cross-sectional view, of a second embodiment, showing the right side buoyancy chamber in an inflated state and the left side buoyancy chamber in a deflated state.

Turning now to FIG. 7, a second embodiment of the buoyancy device 2, according to the present invention, will now be provided. As this embodiment is very similar to the first embodiment, like reference numerals are utilized for like elements and a detailed discussion will only be provided with respect to the differences between the second embodiment versus the first embodiment. In this embodiment, each second section 29 of the buoyancy leg 18 is eliminated and the first section 27, of two mating pairs of the buoyancy legs 18, are utilized in combination with one another. That is, the first section 27 of one buoyancy leg 18 extends perpendicular and radially relative to the longitudinal axis LA of the shaft 10 while the other first section 27 of the buoyancy leg 18 also extends perpendicular and radially relative to the longitudinal axis LA of the shaft 10, but in an opposite direction. By this arrangement, the two opposed first sections 27 are co-axial with one another but both extend normal to the shaft 10.

As the second section 29 of both of the opposed buoyancy legs 18 are eliminated, a single weight 44 can be accommodated within the interior of the shaft 10. In addition, both linkage arms 46 are shorter and are both connected to the same weight 44, but to opposed end faces of the weight 44. In the balanced state, according to this embodiment, both of the pistons 38 are located at a central position within their respective buoyancy chambers 22 and the weight 44' is located substantially centered with respect to the longitudinal axis of the shaft 10, as shown by the dotted lines. It is to be appreciated that the weight 44' must be designed, shaped and/or sized so that the weight 44' is able to move distance D, within the shaft 10, to ensure that both pistons 38 are able to move from their fully retracted position to their fully extended position and vice versa.

As seen in FIG. 7, the piston 38 (shown on the right hand side of that figure) is in a fully extended position while the piston 38 (on the left hand side of that Figure) is in a fully retracted position. As with the first embodiment, a plurality of other buoyancy legs 18 are similarly arranged and spaced axially along the shaft to provide desired rotation of the shaft 10 during use. However, all of the plurality of other buoyancy legs 18 are combined as mating pairs of the buoyancy legs 18, as described above.

Figure 8:
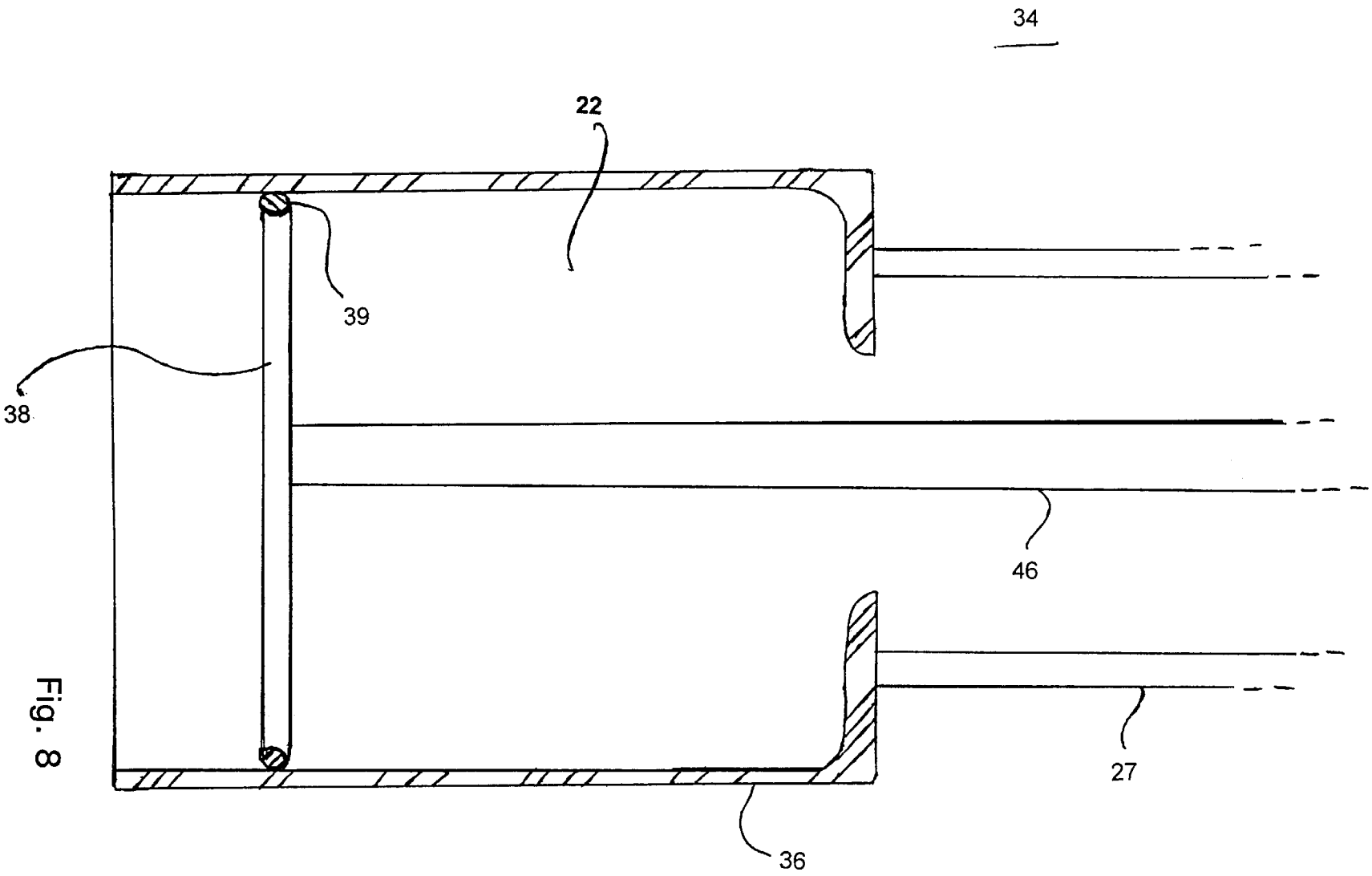
FIG. 8 is a diagrammatic cross-sectional view showing an air cylinder for use as the buoyancy chamber.

Turning now to FIG. 8, a diagrammatic cross-sectional view of a conventional air cylinder, which can be utilized as a buoyancy chamber 22, is shown. According to this embodiment, both piston 38 as well as the housing 40 are manufactured from aluminum. The piston 38 has a perimeter sealing gasket or some other similar conventional sealing member 39 to provide a fluid, e.g. an air and water tight seal between the circumference of the piston 38 and the inwardly facing surface of the housing 42 as the piston 38 moves to and fro along the interior of the housing 42. In all other respects, this buoyancy chamber 22 is substantially identical in function and operation to the previously described buoyancy chamber except that this buoyancy chamber eliminates the need for a diaphragm 50.

Since certain changes may be made in the above described buoyancy device, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A shaft supporting a buoyancy leg carrying a buoyancy chamber which when inflated, providing rotation to the shaft, the shaft comprising:

an elongate at least partially hollow shaft defining a rotational axis;

at least one buoyancy leg being supported by the shaft, the at least one buoyancy leg being coupled to the shaft, in a fluid tight manner; the at least one buoyancy leg extending substantially perpendicular and radially from the rotational axis of the shaft; the buoyancy leg comprising a first section and a second section, which both extend normal to and radially from the shaft, the second section housing a weight for counterbalancing the first section of the buoyancy leg, and the weight being connected to the piston, via a linkage arm, to control operation thereof; a spring bias detent being supported by the second section of the buoyancy leg for locking the weight in one of two positions to facilitate maintaining the weight, and, in turn, the piston in one of a fully retracted first state and a fully extended second state; and a remote end of the buoyancy leg supporting the buoyancy chamber containing the piston, and the piston, when in the first state, providing a substantially balanced state for the shaft, and the piston, when in the second state, causing the buoyancy chamber to become buoyant and thereby supply rotational energy to the shaft, once the buoyancy chamber is immersed in water.

2. The shaft supporting a buoyancy leg according to claim 1, wherein the first section of two of the plurality of buoyancy legs are opposed and co-axial with one another; and a single weight is supported within the co-axial shafts and the single weight is coupled to both of the pistons of the co-axial shafts, via two separate linkage arms, to simultaneously control operation of both pistons during operation of the shaft.

3. A shaft supporting a plurality of buoyancy legs each carrying a buoyancy chamber which, when inflated, providing rotation to the shaft, the shaft comprising:

an elongate substantially at least partially hollow shaft defining a rotational axis;

a plurality of buoyancy legs being supported by the shaft, each of the plurality of buoyancy legs being coupled to the shaft, in a fluid tight manner; and each of the plurality of buoyancy legs extending substantially perpendicular and radially from the rotational axis of the shaft;

each of the plurality of buoyancy legs comprising a first section and a second section, which both extend normal to and radially from the shaft, the second section housing a weight for counterbalancing the first section of the buoyancy leg, and the weight being connected to the piston, via a linkage arm, to control operation thereof; a spring bias detent being supported by the second section of the buoyancy leg for locking the weight in one of two positions to facilitate maintaining the weight, and, in turn, the piston in one of a fully retracted first state and a fully extended second state; and a remote end of the buoyancy leg supporting the buoyancy chamber containing the piston, and the piston, when in the first state, providing a substantially balanced state for the shaft, and the piston, when in the second state, causing the buoyancy chamber to become buoyant and thereby supply rotational energy to the shaft, once the buoyancy chamber is immersed in water.

4. The shaft supporting a buoyancy leg according to claim 3, wherein the plurality of buoyancy arms are equally spaced about the circumference of the shaft to sequentially provide desired rotation to the shaft when immersed in water.

5. The shaft supporting a buoyancy leg according to claim 3, wherein the first section of two of the plurality of buoyancy legs are opposed and co-axial with one another; and a single weight is supported within the co-axial shafts and the single weight is coupled to both of the pistons of the co-axial shafts, via two separate linkage arms, to simultaneously control operation of both pistons during operation of the shaft.

6. The shaft supporting a buoyancy leg according to claim 3, used in combination with a tank for holding a suitable quantity of water, the tank having a pair of opposed sidewalls which are each provided with an aperture for accommodating opposed ends of the shaft, and a waterproof bearing is located in the aperture and support the shaft in a watertight manner.

7. The shaft supporting a buoyancy leg according to claim 3, wherein at least one projecting end portion of the shaft supports a gear for transporting torque generating by the shaft to a desired device.

8. The shaft supporting a buoyancy leg according to claim 7, wherein the gear transmits the torque generated by the shaft to the desired device via one of a chain and a belt drive.

9. The shaft supporting a buoyancy leg according to claim 3, wherein there are six (6) buoyancy arms equally spaced about a circumference of the shaft, and are spaced at an angle of about 60° relative to any two adjacent buoyancy arms.

10. The shaft supporting a buoyancy leg according to claim 3, wherein each of the plurality of buoyancy arms is a substantially hollow and provides fluid communication between the piston, located within the associated buoyance chamber, and an interior of the shaft.

11. The shaft supporting a buoyancy leg according to claim 3, wherein a diaphragm is sealingly connected with an intermediate surface of the buoyancy chamber and also connected to the piston, located within the associated buoyancy chamber, to facilitate inflation and deflation of the buoyancy chamber.

12. The shaft supporting a buoyancy leg according to claim 3, wherein each piston has a outer perimeter seal located to sealingly engage with an inwardly facing surface of the buoyancy chamber to provide a fluid tight seal therewith while allowing movement the piston relative to the buoyancy chamber.

13. The shaft supporting a buoyancy leg according to claim 3, wherein at least one end of the shaft is open to facilitate the flow of air into and out of the buoyance chamber, via the buoyance legs, as the pistons move during operation of the shaft.

14. The shaft supporting a buoyancy leg according to claim 3, wherein each buoyance chamber has a cavity size of about 20 to 200 cubic inches.

15. The shaft supporting a buoyancy leg according to claim 3, wherein the piston has a mechanism which facilitates sliding movement of the piston relative to the buoyancy chamber while maintaining a fluid tight seal between the piston and an inwardly facing surface of the buoyancy chamber.

16. The shaft supporting a buoyancy leg according to claim 3, wherein the second section of the buoyancy leg is shorter than the first section of the buoyancy leg.

17. The shaft supporting a buoyancy leg according to claim 3, wherein the weight is cylindrical in shape and is provided with a pair of opposed annular recesses located for engagement with the spring bias detent for temporarily retaining the piston in one of the first state and the second state.

18. The shaft supporting a buoyancy leg according to claim 3, wherein the spring bias detent includes a latch coupled to a handle, and movement of the handle for a first position to a second position facilitates operation of the spring bias detent during rotation of the shaft.

19. A shaft supporting a plurality of buoyancy legs each carrying a buoyancy chamber which, when inflated, providing rotation to the shaft, the shaft comprising:

an elongate substantially at least partially hollow shaft defining a rotational axis;

a plurality of buoyancy legs being supported by the shaft, each of the plurality of buoyancy legs being coupled to the shaft, in a fluid tight manner; and each of the plurality of buoyancy legs extending substantially perpendicular and radially from the rotational axis of the the shaft;

each of the plurality of buoyancy legs comprising a first section and a second section, which both extend normal to and radially from the shaft, the second section housing a weight for counterbalancing the first section of the buoyancy leg, and the weight being connected to the piston, via a linkage arm, to control operation thereof;

a remote end of the buoyancy leg supporting a buoyancy chamber containing a piston, and the piston, when in a first state, providing a substantially balanced state for the shaft, and the piston, when in a second state, causing the buoyancy chamber to become buoyant and thereby supply rotational energy to the shaft, once the buoyancy chamber is immersed in water, the first section of two of the plurality of buoyancy legs being opposed and co-axial with one another; and a single weight being supported within the co-axial shafts and the single weight being coupled to both of the pistons of the co-axial shafts, via two separate linkage arms, to simultaneously control operation of both pistons during operation of the shaft.

20. The shaft supporting a buoyancy leg according to claim 19, wherein a spring bias detent is supported by the second section of the buoyancy leg for locking the weight in one of two positions to facilitate maintaining the weight, and, in turn, the piston in one of a fully extended state and a fully retracted state.

* * * * *